US010584558B2

(12) United States Patent
Manke

(10) Patent No.: US 10,584,558 B2
(45) Date of Patent: Mar. 10, 2020

(54) DOWNHOLE PACKER TOOL

(71) Applicant: Thru Tubing Solutions, Inc., Oklahoma City, OK (US)

(72) Inventor: Kevin Manke, Blanchard, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 150 days.

(21) Appl. No.: 15/192,198

(22) Filed: Jun. 24, 2016

(65) Prior Publication Data

US 2016/0376868 A1 Dec. 29, 2016

Related U.S. Application Data

(60) Provisional application No. 62/184,100, filed on Jun. 24, 2015.

(51) Int. Cl.

| | |
|---|---|
| ***E21B 34/08*** | (2006.01) |
| ***E21B 33/128*** | (2006.01) |
| ***E21B 33/124*** | (2006.01) |
| *E21B 34/00* | (2006.01) |

(52) U.S. Cl.

CPC ..... *E21B 34/08* (2013.01); *E21B 33/124* (2013.01); *E21B 33/1285* (2013.01); *E21B 2034/002* (2013.01)

(58) Field of Classification Search

CPC ..... E21B 33/124; E21B 33/1208; E21B 33/1295; E21B 33/128; E21B 33/1285

See application file for complete search history.

(56) References Cited

U.S. PATENT DOCUMENTS 2,228,241 A * 1/1941 Baker ..... E21B 33/1295 166/120
2,715,444 A * 8/1955 Fewel ..... E21B 33/124 166/147
2,927,638 A * 3/1960 Hall, Sr. ..... E21B 33/1295 166/122
2,946,388 A * 7/1960 Evans ..... E21B 33/1295 166/120
2,978,028 A * 4/1961 Webb ..... E21B 23/065 166/125
3,333,459 A * 8/1967 Claycomb ..... E21B 33/124 73/40.5 R (Continued)

*Primary Examiner* — Kipp C Wallace
(74) *Attorney, Agent, or Firm* — Hall Estill Law Firm

(57) ABSTRACT

A packer comprising a mandrel having a radially directed port disposed therein and a passageway axially disposed therein and a packer element disposed around a portion of the mandrel. The packer further includes a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold. The packer can be included in a downhole assembly having an upper packer and a lower packer. A method of using the packer includes placing the packer into a wellbore to seal one zone from another and pumping fluid into the packer to set the packer element against a casing in the wellbore. A method of using the assembly that incorporates the upper packer and the lower packer is also described.

26 Claims, 5 Drawing Sheets

(56) References Cited

U.S. PATENT DOCUMENTS

| | | | | | |
|---|---|---|---|---|---|
| 3,765,484 | A * | 10/1973 | Hamby, Jr. | E21B 33/12 | 166/147 |
| 3,899,920 | A * | 8/1975 | Matherne | G01M 3/2853 | 73/40.5 R |
| 4,058,166 | A * | 11/1977 | Crickmer | E21B 23/06 | 166/120 |
| 4,279,306 | A * | 7/1981 | Weitz | E21B 37/08 | 166/147 |
| 4,444,252 | A * | 4/1984 | Fisher, Jr. | E21B 33/1295 | 166/134 |
| 4,487,258 | A * | 12/1984 | Jackson | E21B 33/1295 | 166/120 |
| 4,519,238 | A * | 5/1985 | Hailey | G01M 3/2853 | 73/40.5 R |
| 5,692,564 | A * | 12/1997 | Brooks | E21B 23/02 | 166/127 |
| 6,695,057 | B2 * | 2/2004 | Ingram | E21B 33/124 | 166/185 |
| 8,695,697 | B2 * | 4/2014 | Derby | E21B 33/1285 | 166/129 |
| 2016/0177658 | A1 * | 6/2016 | Lee | E21B 33/1285 | 166/305.1 |
| 2017/0145784 | A1 * | 5/2017 | Zhou | E21B 33/128 | |

* cited by examiner

DOWNHOLE PACKER TOOL

CROSS-REFERENCE TO RELATED APPLICATIONS

The present application is a conversion of U.S. Provisional Application having U.S. Ser. No. 62/184,100, filed Jun. 24, 2015, which claims the benefit under 35 U.S.C. 119(e), the disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a downhole packer that is used to seal one zone of a well (or formation) from a second zone of the well (or formation). The downhole packer can be an upper packer or a lower packer and both can be incorporated in a bottom-hole assembly (BHA).

2. Description of the Related Art

Various mechanical mechanisms are used to set downhole packers in a wellbore. Various problems are encountered with the mechanical mechanisms when attempting to set the packer in a wellbore.

Accordingly, there is a need for a downhole packer that can be set using differential pressure acting over a hydraulic area.

SUMMARY OF THE DISCLOSURE

The present disclosure is directed to a packer comprising a mandrel having a radially directed port disposed therein and a passageway axially disposed therein and a packer element disposed around a portion of the mandrel. The packer further includes a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold. The present disclosure is also directed toward a downhole assembly that includes an upper packer and a lower packer as described herein.

The disclosure is also directed towards a method of using the packer described herein. The method includes placing the packer into a wellbore to seal one zone from another and pumping fluid into the packer to set the packer element against a casing in the wellbore. The disclosure is also directed toward method of using the assembly that incorporates the upper packer and the lower packer.

DETAILED DESCRIPTION OF THE DISCLOSURE

Figure 1:
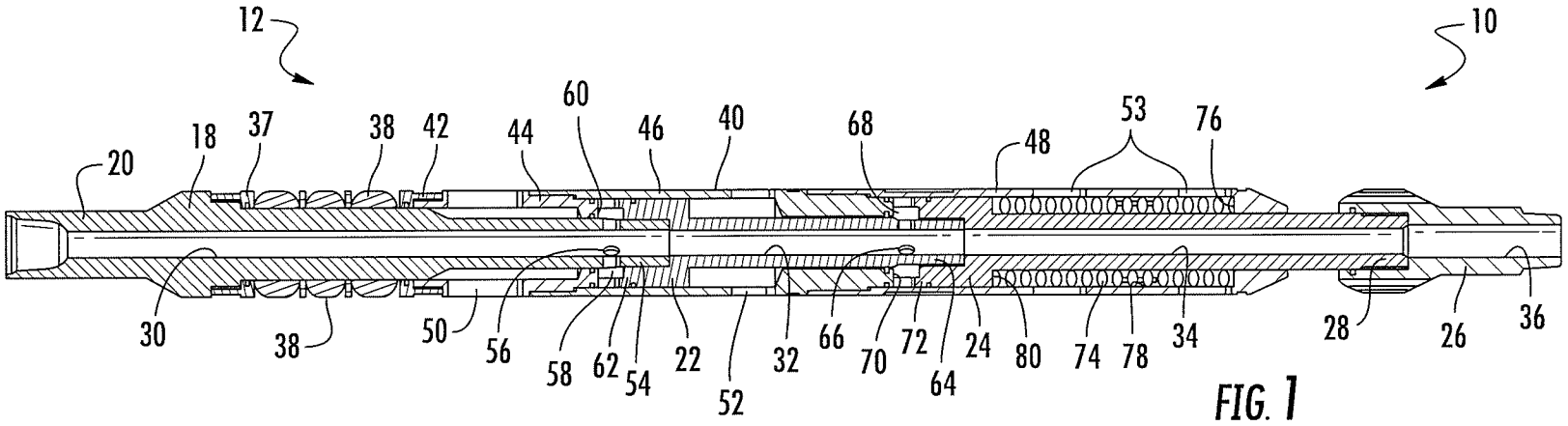
FIG. 1 is a cross-section view of a packer tool constructed in accordance with the present disclosure.
Figure 2:
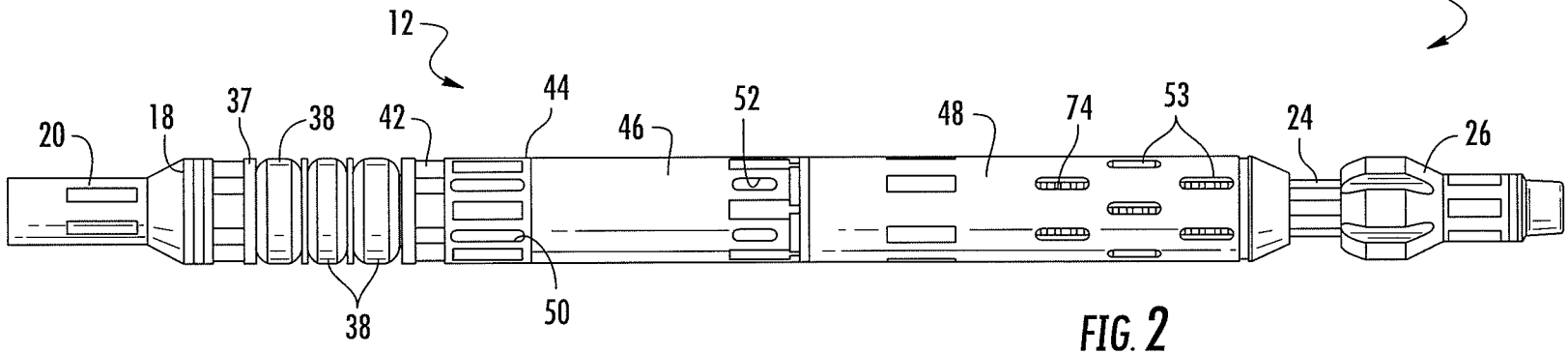
FIG. 2 is a side elevation view of the packer tool shown in FIG. 1 and constructed in accordance with the present disclosure.
Figure 3:
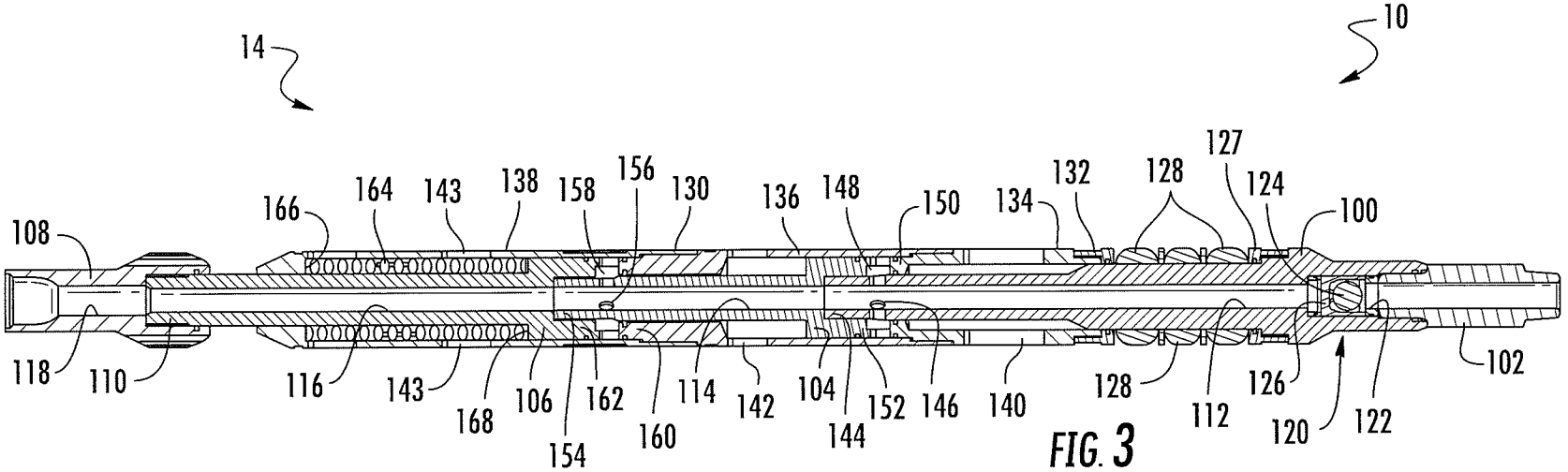
FIG. 3 is a cross-section view of another embodiment of a packer tool constructed in accordance with the present disclosure.
Figure 4:
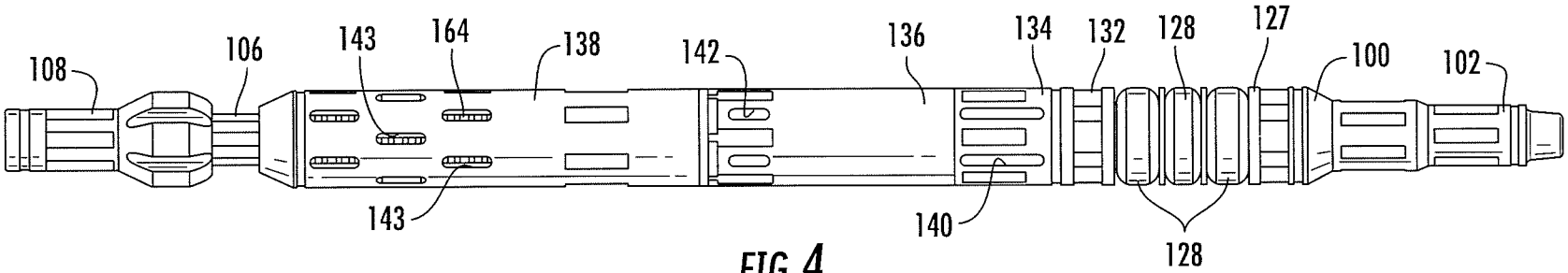
FIG. 4 is a side elevation view of the packer tool shown in FIG. 3 and constructed in accordance with the present disclosure.
Figure 5A:
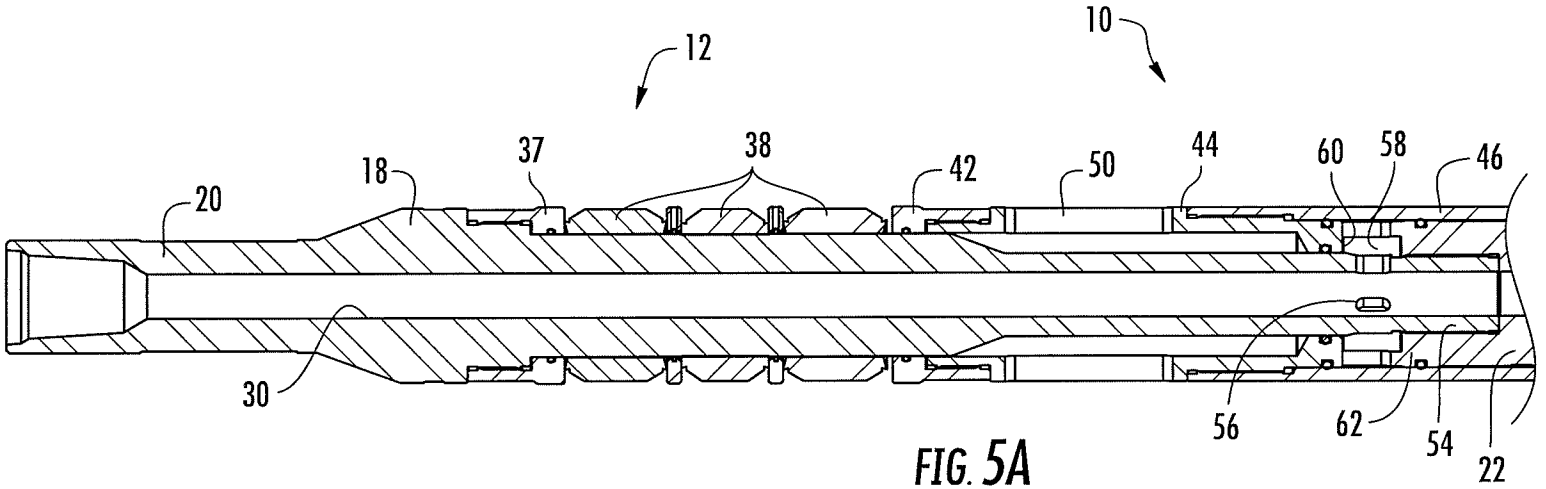
FIG. 5A is a cross-sectional view of an upper part of the packer tool shown in FIGS. 1 and 2 and constructed in accordance with the present disclosure.
Figure 5B:
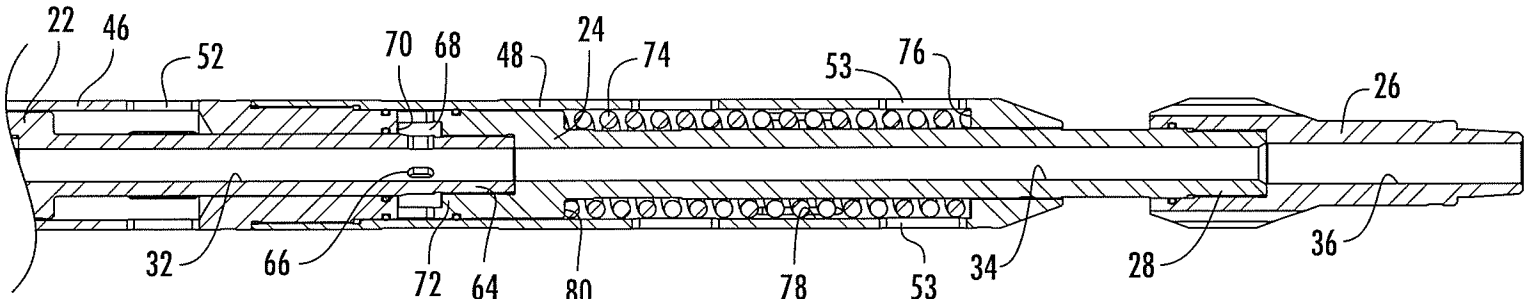
FIG. 5B is a cross-sectional view of a lower part of the packer tool shown in FIGS. 1 and 2 and constructed in accordance with the present disclosure.
Figure 6A:
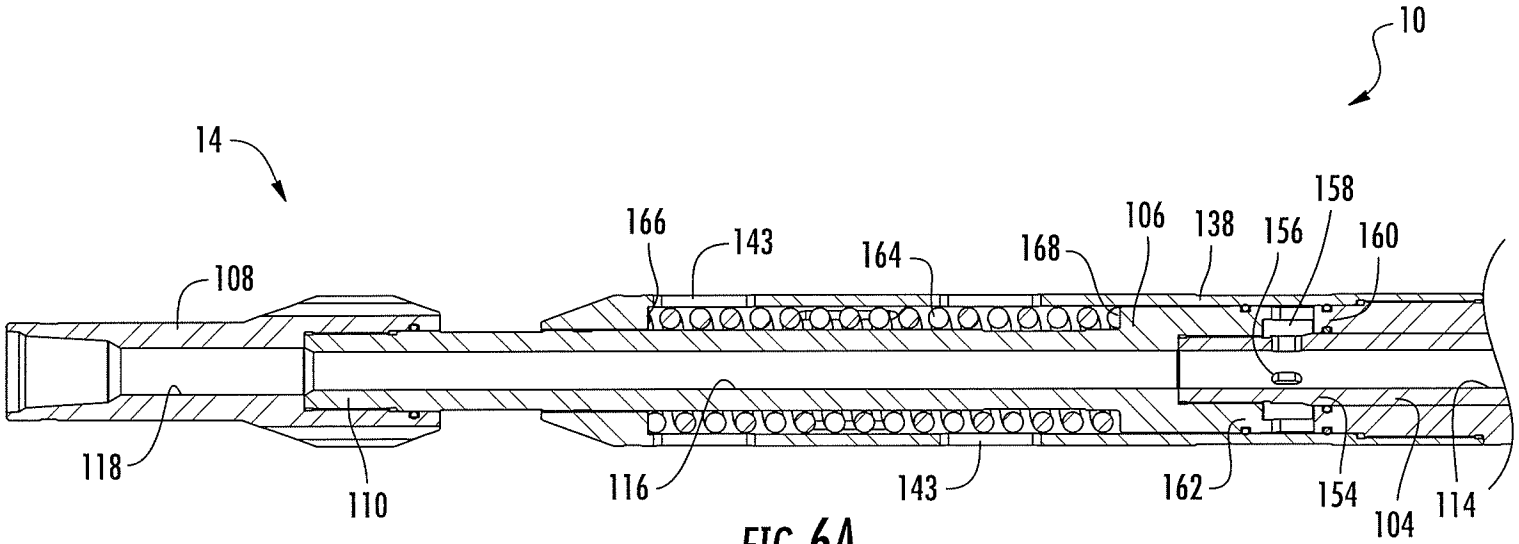
FIG. 6A is a cross-sectional view of an upper part of the packer tool shown in FIGS. 3 and 4 and constructed in accordance with the present disclosure.
Figure 6B:
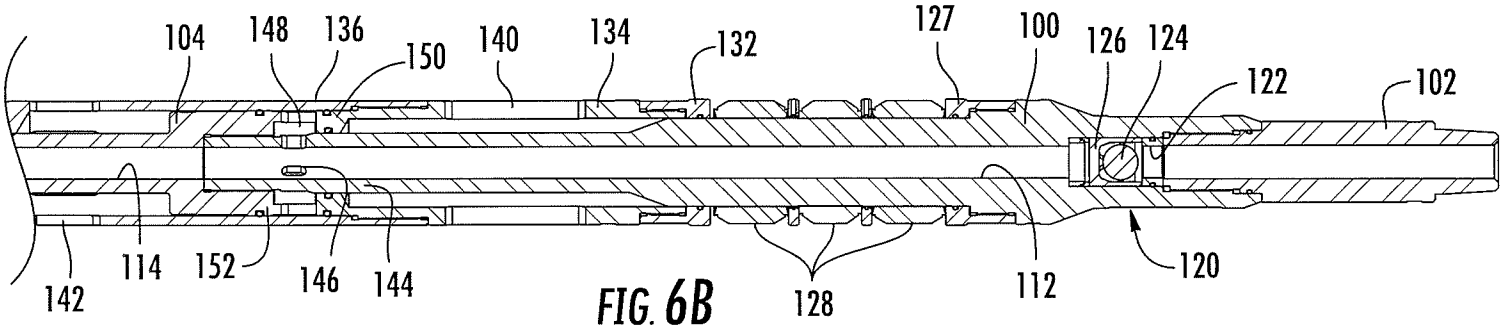
FIG. 6B is a cross-sectional view of a lower part of the packer tool shown in FIGS. 3 and 4 and constructed in accordance with the present disclosure.

The present disclosure relates to a downhole packer 10 that is used to seal one zone of a well (or formation) from a second zone of the well (or formation). The downhole packer 10 can be an upper packer 12 or a lower packer 14. The disclosure also relates to a bottom hole assembly (BHA) 16 that can include more than one of the downhole packers disclosed herein to seal a specific portion of the well (or formation) from an upper part of the well and a lower part of the well. Also disclosed herein is a method of using the downhole packer(s) to treat the well, or formation.

In one embodiment shown in FIGS. 1-2 and 5A-5B, an upper packer 12 is described. The upper packer 12 includes a first mandrel 18 attachable to a top sub portion 20 or configured with a top sub portion 20 for attachment to other tools disposed above the upper packer 12 in the BHA 16. The upper packer 12 also includes a second mandrel 22 attached to the first mandrel 18 and a third mandrel 24 attached to the second mandrel 22. The upper packer 12 can further include a bottom sub 26 attached to a lower end 28 of the third mandrel 24. The first, second and third mandrels 18, 22, 24 and the bottom sub 26 have fluid passageways 30, 32, 34 and 36 disposed therein, respectively, to permit fluid to flow through the upper packer 12.

The upper packer 12 also includes a shoulder element 37 disposed around a portion of the first mandrel 18 and adjacent to at least one packer element 38 disposed around a portion of the first mandrel 18 to engage a casing in a wellbore when the pressure of fluid inside the upper packer 12 reaches a certain threshold. The shoulder element 37 can be built into the first mandrel 18 or be a separate element disposed on the first mandrel 18. The upper packer 12 further includes a housing 40 that can be constructed of multiple portions. In one embodiment, the housing 40 includes a first housing portion 42 disposed adjacent to the at least one packer element 38 and around a portion of the first mandrel 18. The first housing portion 42 is attached to a second housing portion 44, the second housing portion 44 is attached to a third housing portion 46 and the third housing portion 46 is attached to a fourth housing portion 48.

The first and second housing portions 42 and 44 are slidably disposed on the first mandrel 18. The third housing portion 46 is slidably disposed on the second mandrel 22 and the fourth housing portion 48 is slidbaly disposed on the third mandrel 24. Furthermore, the second and third housing portions 44 and 46 can have radial directed slots (or ports) 50 and 52, respectively, cut therein to allow for pressurized fluid to escape certain parts of the upper packer 12. The fourth housing portion 48 can also have radial directed ports 53 disposed therein to permit fluid disposed inside the fourth housing portion 48 to escape in various situations.

In one embodiment, one end 54 of the first mandrel 18 includes radially directed ports 56 disposed therein to allow fluid to pass into a first annulus area 58. The first annulus area 58 is disposed between the third housing portion 46 and the first mandrel 18 and between one end 60 of the second housing portion 44 and one end 62 of the second mandrel 22. In another embodiment, a second end 64 of the second mandrel 22 includes radially directed ports 66 disposed therein to permit fluid to pass from the passageway 32 disposed in the second mandrel 22 into a second annulus area 68. The second annulus area 68 is disposed between the fourth housing portion 48 and the second mandrel 22 and between one end 70 of the third housing portion 46 and one end 72 of the third mandrel 24. It should be understood and appreciated that more radially directed port locations in the first and second mandrels 18 and 22 can be implemented than the two radially directed port locations that have been disclosed herein in the first and second mandrels 18 and 22 for the upper packer 12 disclosed herein.

The upper packer 12 can also include a spring 74 disposed around a portion of the third mandrel 24 and inside the fourth housing portion 48. The spring 74 is also disposed between a shoulder 76 disposed on the inside of the fourth housing portion 48 and a shoulder 80 disposed on the third mandrel 24. In a further embodiment, the upper packer 12 can include additional mandrels designed like the second mandrel 22 disposed between the first mandrel 18 and the third mandrel 24 and have additional annulus areas designed like the second annulus area 68 to cooperate with the additional mandrels to provide additional force to further compress the packer elements 38.

In use, fluid is pumped into and through the upper packer 12. Once the pressure of the fluid in the upper packer 12 surpasses a certain fluid pressure threshold, the fluid in the first annulus area 58 and/or the second annulus area 68 increases the size of the first annulus area 58 and/or the second annulus area 68 in the axial direction. The fluid forcing the size of the first annulus area 58 and/or the second annulus area 68 to increase forces the housing 40 (and all housing portions 42, 44, 46, and 48) to squeeze the at least one packer element 38 and force the packer element 38 to engage the casing. The spring 74 disclosed herein is also compressed when the pressure of the fluid in the upper packer 12 is increased above the fluid pressure threshold. When desirable, the fluid pressure in the upper packer 12 can be reduced below the fluid pressure threshold, which permits the spring 74 to decompress and reduce the pressure the housing 40 (and the housing portions 42, 44, 46 and 48) was applying to the packer element 38. When the spring 74 is permitted to decompress, the housing 40 no longer squeezes the at least one packer element 38 hard enough to engage the casing and seal the wellbore.

In another embodiment shown in FIGS. 3-4 and 6A-6B the lower packer 14 is described. The lower packer 14 includes a first mandrel 100 attachable to a bottom sub 102 for attachment to other tools disposed below the lower packer 14 in the BHA 16. The lower packer 14 also includes a second mandrel 104 attached to the first mandrel 100 and a third mandrel 106 attached to the second mandrel 104. The lower packer 14 can further include a top sub 108 attached to an upper end 110 of the third mandrel 106 for attachment to other tools disposed above the lower packer 14 included in the BHA 16. The first mandrel 100, the second mandrel 104, the third mandrel 106, and the top sub 108 have fluid passageways 112, 114, 116 and 118, respectively, disposed therein to permit fluid to flow through the lower packer 14.

In this embodiment, the lower packer 14 can further include a check valve 120 to prevent fluid from flowing past the check valve 120 and out of the lower packer 14 in the downhole direction, but permits fluid to flow past the check valve 120 and into the lower packer 14 in the uphole direction. In one embodiment, the check valve 120 can be a ball check valve 120 that includes a seat 122 for preventing a fluid blocking member 124 (such as a ball) from flowing past seat 122 in the downhole direction, thus blocking fluid from passing through the check valve 120 and out of the downhole packer 14 as well. The check valve 120 can also include an encapsulation device 126 to prevent the fluid blocking member 124 from leaving the check valve 120, yet still permit fluid to flow through the check valve 120 in the uphole direction.

The lower packer 14 also includes a shoulder element 127 disposed around a portion of the first mandrel 100 and adjacent to at least one packer element 128 disposed around a portion of the first mandrel 100 to engage a casing in a wellbore when the pressure of fluid inside the lower packer 14 reaches a certain threshold. The shoulder element 127 can be built into the first mandrel 100 or be a separate element disposed on the first mandrel 100. The lower packer 14 further includes a housing 130 that can be constructed of multiple portions. In one embodiment, the housing 130 includes a first housing portion 132 disposed adjacent to the at least one packer element 128 and around a portion of the first mandrel 100. The first housing portion 132 is attached to a second housing portion 134, the second housing portion 134 is attached to a third housing portion 136 and the third housing portion 136 is attached to a fourth housing portion 138.

The first and second housing portions 132 and 134 are slidably disposed on the first mandrel 100. The third housing portion 136 is slidably disposed on the second mandrel 104 and the fourth housing portion 138 is slidbaly disposed on the third mandrel 106. Furthermore, the second and third housing portions 134 and 136 can have radial directed ports 140 and 142, respectively, cut therein to allow for pressurized fluid to escape certain parts of the lower packer 14. The fourth housing portion 138 can also have radial directed ports 143 disposed therein to permit fluid disposed inside the fourth housing portion 138 to escape in various situations.

In one embodiment, one end 144 of the first mandrel 100 includes radially directed ports 146 disposed therein to allow fluid to pass into a first annulus area 148. The first annulus area 148 is disposed between the third housing portion 136 and the first mandrel 100 and between one end 150 of the second housing portion 134 and one end 152 of the second mandrel 104. In another embodiment, a second end 154 of the second mandrel 104 includes radially directed ports 156 disposed therein to permit fluid to pass from the passageway 114 disposed in the second mandrel 104 into a second annulus area 158. The second annulus area 158 is disposed between the fourth housing portion 138 and the second mandrel 104 and between one end 160 of the third housing portion 136 and one end 162 of the third mandrel 106. It should be understood and appreciated that more radially directed port locations in the first and second mandrels 100 and 104 can be implemented than the two radially directed port locations that have been disclosed herein in the first and second mandrels 100 and 104 for the lower packer 14 disclosed herein.

The lower packer 14 can also include a spring 164 disposed around a portion of the third mandrel 106 and inside the fourth housing portion 138. The spring 164 is also disposed between a shoulder 166 disposed on the inside of the fourth housing portion 138 and a shoulder 168 disposed on the third mandrel 106. In a further embodiment, the lower packer 14 can include additional mandrels designed like the second mandrel 104 disposed between the first mandrel 100 and the third mandrel 106 and have additional annulus areas designed like the second annulus area 158 to cooperate with the additional mandrels to provide additional force to further compress the packer elements 128.

In use, fluid is pumped into the lower packer 14 and into the check valve 120. Once the pressure of the fluid surpasses a certain threshold, the fluid in the first annulus area 148 and/or the second annulus area 158 increases the size of the first annulus area 148 and/or the second annulus area 158 in the axial direction. The fluid forcing the size of the first annulus area 148 and/or the second annulus area 158 to increase forces the housing 130 (and all housing portions 132, 134, 136 and 138) to squeeze the at least one packer element 128 and force the packer element 128 to engage the casing. The spring 164 disclosed herein is compressed at this threshold fluid pressure. When desirable, the fluid pressure in the lower packer 14 can be reduced below the threshold fluid pressure, which permits the spring 164 to decompress and reduce the pressure the housing 130 was applying to the packer element 128. The decompression of the spring 164 forces the housing 130 in the uphole direction and the packer element 128 disengages with the casing permitting the lower packer 14 to be moved in the casing.

Figure 7:
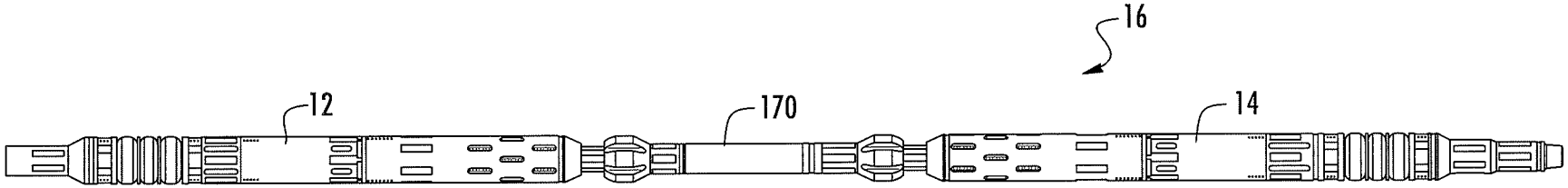
FIG. 7 is a side elevation view of a bottom hole assembly constructed in accordance with the present disclosure.

In another embodiment shown in FIG. 7, the upper packer 12 and the lower packer 14 can be used simultaneously in the BHA 16. The upper packer 12 is positioned in a wellbore above a zone where treatment of the well is desirable and the lower packer 14 is positioned in the wellbore below the zone where treatment of the well is desirable. In this embodiment, a treatment tool 170, such as a ported sub, is positioned between the upper packer 12 and the lower packer 14 in the BHA 16. Thus, fluid can be provided to the BHA 16 to set the packer elements 38 and 128 in the upper packer 12 and the lower packer 14 as described herein. The formation can then be treated by the treatment tool 170. Once treatment of the zone of the formation is completed, the fluid pressure can be reduced below the threshold fluid pressure and the packer elements 38 and 128 disengage from the casing. The BHA 16 can then be moved to another zone in the formation to be treated.

It should be understood and appreciated that numerous other downhole tools can be used with the upper packer 12 and/or the lower packer 14 in the BHA 16. Examples of these numerous other downhole tools include, but are not limited to, injection control valves, circulating valves, anchoring subs, disconnects, jars, gauge carriers, gauges and the like. Furthermore, it should be understood and appreciated that the treatment tool 170 can be any type or number of downhole tools used to treat an oil and gas well known in the art.

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A packer, the packer comprising:

a mandrel having a radially directed port disposed therein and a passageway axially disposed therein;

a packer element disposed around a portion of the mandrel; and a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold, the radially directed port in direct fluid communication with the passageway in the mandrel and fluid flowing through the packer, the fluid flowing through the packer being able to flow completely through the packer, the housing includes at least two radially directed ports disposed therein wherein one of the radially directed ports in the housing is disposed uphole of the radially directed port disposed in the mandrel and another of the radially directed ports in the housing is disposed downhole of the radially directed port disposed in the mandrel.

2. The packer of claim 1 further comprising:

a second mandrel attached to the first mandrel on a first end of the second mandrel, the second mandrel having a radial directed port disposed therein and a passageway axially disposed therein; and a second annulus area disposed between the second mandrel and the housing, the second annulus area axially expandable as fluid is flowed through the passageway and the radially directed port of the second mandrel into the second annulus area above the fluid pressure threshold.

3. The packer of claim 2 further comprising:

a third mandrel attached to the second mandrel; and a spring disposed around a portion of the third mandrel and inside the housing to push the housing away from the packer element when fluid inside the packer falls below the fluid pressure threshold.

4. The packer of claim 1 wherein the housing is constructed of multiple housing portions and the housing includes multiple radially directed ports therein.

5. The packer of claim 3 wherein the first mandrel is attached to a top sub or includes a top sub portion built therein for attachment to other downhole tools disposed above the packer and the third mandrel is attached to a bottom sub for attachment to other downhole tools disposed below the packer.

6. The packer of claim 3 wherein the first mandrel is attached to a bottom sub for attachment to other downhole tools disposed below the packer and the third mandrel is attached to a top sub for attachment to other downhole tools disposed above the packer.

7. The packer of claim 6 wherein the packer further includes a check valve to prevent fluid from flowing out of the bottom of the packer and allow fluid to flow up into the packer from below the packer.

8. The packer of claim 7 where the check valve comprises:

a seat and a fluid blocking member disposed uphole of the seat to engage the seat to prevent fluid from flow down and out of the packer; and an encapsulation device for housing the fluid blocking member to prevent the fluid blocking member from escaping the check valve and adjacent to the seat.

9. A method, the method comprising:

placing a packer into a wellbore to seal one zone from another, the packer comprising:

a mandrel having a radially directed port disposed therein and a passageway axially disposed therein;

a packer element disposed around a portion of the mandrel; and a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold, the radially directed port in direct fluid communication with the passageway in the mandrel and fluid flowing through the packer, the fluid flowing through the packer being able to flow completely through the packer, the housing includes at least two radially directed ports disposed therein wherein one of the radially directed ports in the housing is disposed uphole of the radially directed port disposed in the mandrel and another of the radially directed ports in the housing is disposed downhole of the radially directed port disposed in the mandrel; and pumping fluid into the packer to set the packer element against a casing in the wellbore.

10. The method of claim 9 further comprising:

a second mandrel attached to the first mandrel on a first end of the second mandrel, the second mandrel having a radially directed port disposed therein and a passageway axially disposed therein; and a second annulus area disposed between the second mandrel and the housing, the second annulus area axially expandable as fluid is flowed through the passageway and the radially directed port of the second mandrel into the second annulus area above the fluid pressure threshold.

11. The method of claim 10 further comprising:

a third mandrel attached to the second mandrel; and a spring disposed around a portion of the third mandrel and inside the housing to push the housing away from the packer element when fluid inside the packer falls below the fluid pressure threshold.

12. The method of claim 9 wherein the housing is constructed of multiple housing portions and the housing includes multiple radially directed ports therein.

13. The method of claim 11 wherein the first mandrel is attached to a top sub or includes a top sub portion built therein for attachment to other downhole tools disposed above the packer and the third mandrel is attached to a bottom sub for attachment to other downhole tools disposed below the packer.

14. The method of claim 11 wherein the first mandrel is attached to a bottom sub for attachment to other downhole tools disposed below the packer and the third mandrel is attached to a top sub for attachment to other downhole tools disposed above the packer.

15. The method of claim 14 wherein the packer further includes a check valve to prevent fluid from flowing out of the bottom of the packer and allow fluid to flow up into the packer from below the packer.

16. The method of claim 15 where the check valve comprises:

a seat and a fluid blocking member disposed uphole of the seat to engage the seat to prevent fluid from flow down and out of the packer; and an encapsulation device for housing the fluid blocking member to prevent the fluid blocking member from escaping the check valve and adjacent to the seat.

17. A bottom hole assembly, the assembly comprising:

an upper packer for sealing an upper portion of a zone in a casing, the upper packer comprising:

a mandrel having a radially directed port disposed therein and a passageway axially disposed therein;

a packer element disposed around a portion of the mandrel; and a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold, the radially directed port in direct fluid communication with the passageway in the mandrel and fluid flowing through the packer, the fluid flowing through the packer being able to flow completely through the packer, the housing includes at least two radially directed ports disposed therein wherein one of the radially directed ports in the housing is disposed uphole of the radially directed port disposed in the mandrel and another of the radially directed ports in the housing is disposed downhole of the radially directed port disposed in the mandrel;

a lower packer for sealing a lower portion of a zone in the casing, the lower packer comprising:

a mandrel having a radially directed port disposed therein and a passageway axially disposed therein;

a packer element disposed around a portion of the mandrel; and a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold; and a treatment tool disposed between the upper packer and the lower packer to treat a formation the casing is disposed in.

18. The assembly of claim 17 wherein the upper packer and the lower packer comprise:

a second mandrel attached to the first mandrel on a first end of the second mandrel, the second mandrel having a radially directed port disposed therein and a passageway axially disposed therein; and a second annulus area disposed between the second mandrel and the housing, the second annulus area axially expandable as fluid is flowed through the passageway and the radially directed port of the second mandrel into the second annulus area above the fluid pressure threshold.

19. The assembly of claim 18 wherein the upper packer and the lower packer comprise:

a third mandrel attached to the second mandrel; and a spring disposed around a portion of the third mandrel and inside the housing to push the housing away from the packer element when fluid inside the packer falls below the fluid pressure threshold.

20. The assembly of claim 19 wherein the first mandrel of the upper packer is attached to a top sub or includes a top sub portion built therein for attachment to other downhole tools disposed above the upper packer, the third mandrel of the upper packer is attached to a bottom sub for attachment to other downhole tools disposed below the upper packer, the first mandrel of the lower packer is attached to a bottom sub for attachment to other downhole tools disposed below the lower packer and the third mandrel of the lower packer is attached to a top sub for attachment to other downhole tools disposed above the lower packer.

21. The assembly of claim 20 wherein the lower packer further includes a check valve to prevent fluid from flowing out of the bottom of the packer and allow fluid to flow up into the packer from below the packer.

22. A method, the method comprising:

placing a bottom hole assembly into a wellbore to seal a zone in a casing, the assembly comprising:

an upper packer for sealing an upper portion of a zone in a casing, the upper packer comprising:

a mandrel having a radially directed port disposed therein and a passageway axially disposed therein;

a packer element disposed around a portion of the mandrel; and a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold, the radially directed port in direct fluid communication with the passageway in the mandrel and fluid flowing through the packer, the fluid flowing through the packer being able to flow completely through the packer, the housing includes at least two radially directed ports disposed therein wherein one of the radially directed ports in the housing is disposed uphole of the radially directed port disposed in the mandrel and another of the radially directed ports in the housing is disposed downhole of the radially directed port disposed in the mandrel;

a lower packer for sealing a lower portion of a zone in the casing, the lower packer comprising:

a mandrel having a radially directed port disposed therein and a passageway axially disposed therein;

a packer element disposed around a portion of the mandrel; and a housing disposed around a portion of the mandrel creating an annulus area between the mandrel and the housing, the housing is disposed adjacent to the packer element to squeeze the packer element and axially expand the annulus area when fluid flows through the radially directed port and into the annulus area above a fluid pressure threshold; and a treatment tool disposed between the upper packer and the lower packer to treat a formation the casing is disposed in; and pumping fluid into the assembly to set the packer elements of the upper and lower packers against the casing in the wellbore.

23. The method of claim 22 wherein the upper packer and the lower packer comprise:

a second mandrel attached to the first mandrel on a first end of the second mandrel, the second mandrel having a radially directed port disposed therein and a passageway axially disposed therein; and a second annulus area disposed between the second mandrel and the housing, the second annulus area axially expandable as fluid is flowed through the passageway and the radially directed port of the second mandrel into the second annulus area above the fluid pressure threshold.

24. The method of claim 23 wherein the upper packer and the lower packer comprise:

a third mandrel attached to the second mandrel; and a spring disposed around a portion of the third mandrel and inside the housing to push the housing away from the packer element when fluid inside the packer falls below the fluid pressure threshold.

25. The method of claim 24 wherein the first mandrel of the upper packer is attached to a top sub or includes a top sub portion built therein for attachment to other downhole tools disposed above the upper packer, the third mandrel of the upper packer is attached to a bottom sub for attachment to other downhole tools disposed below the upper packer, the first mandrel of the lower packer is attached to a bottom sub for attachment to other downhole tools disposed below the lower packer and the third mandrel of the lower packer is attached to a top sub for attachment to other downhole tools disposed above the lower packer.

26. The method of claim 25 wherein the lower packer further includes a check valve to prevent fluid from flowing out of the bottom of the packer and allow fluid to flow up into the packer from below the packer.

* * * * *